US007138952B2

(12) United States Patent
Mcgrath et al.

(10) Patent No.: US 7,138,952 B2
(45) Date of Patent: Nov. 21, 2006

(54) ARRAY ANTENNA WITH DUAL POLARIZATION AND METHOD

(75) Inventors: Daniel T. Mcgrath, McKinney, TX (US); Timothy H. Shively, Allen, TX (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/032,914

(22) Filed: Jan. 11, 2005

(65) Prior Publication Data

US 2006/0152426 A1 Jul. 13, 2006

(51) Int. Cl.
*H01Q 1/38* (2006.01)
*H01Q 21/08* (2006.01)

(52) U.S. Cl. ..... 343/751; 343/700 MS; 343/824

(58) Field of Classification Search ..... 343/700 MS, 343/853, 893, 770
See application file for complete search history.

(56) References Cited

U.S. PATENT DOCUMENTS 3,623,112 A 11/1971 Rupp et al. ..... 343/727
4,097,868 A 6/1978 Borowick ..... 343/727
5,185,611 A * 2/1993 Bitter, Jr. ..... 343/702
5,300,936 A * 4/1994 Izadian ..... 343/700 MS
6,160,512 A * 12/2000 Desclos et al. ..... 343/700 MS
6,166,701 A * 12/2000 Park et al. ..... 343/771
6,239,762 B1 * 5/2001 Lier ..... 343/770
6,366,254 B1 * 4/2002 Sievenpiper et al. ..... 343/770

FOREIGN PATENT DOCUMENTS

EP 0 744 787 A1 5/1996
WO WO 03/073552 A1 9/2003

OTHER PUBLICATIONS

EPO Search Report regarding Application No./Patent No. 05257624.6-2220 (6 pages).
"A Notch-Wire Composite Antenna for Polarization Diversity Reception"; Nobuhiro Kuga Hiroyuki Arai and Naohisa Goto; IEEE Transactions on Antennas and Propogation, vol. 46, No. 6, Jun. 1998; pp. 902-906.

* cited by examiner

*Primary Examiner*—Tan Ho
*Assistant Examiner*—Hung Tran Vy
(74) *Attorney, Agent, or Firm*—Baker Botts L.L.P.

(57) ABSTRACT

According to one embodiment of the invention, an array antenna includes a substrate body, a first antenna element, and a second antenna element. The first antenna element is coupled to the substrate body and is operable to transmit or receive a first signal. The second antenna element is coupled to the substrate body and is operable to transmit or receive a second signal. The first antenna element is of a different type than the second antenna element. The direction of polarization of the first signal is different than the direction of polarization of the second signal.

15 Claims, 3 Drawing Sheets

ARRAY ANTENNA WITH DUAL POLARIZATION AND METHOD

TECHNICAL FIELD OF THE INVENTION

The present invention relates generally to the field of array antennas and more particularly, but not by way of limitation, to an array antenna with dual polarization and method.

BACKGROUND OF THE INVENTION

Electronic scanning antennas capable of dual polarization are beneficial in a variety of applications. For example, the utilization of such antennas in a synthetic aperture radar allows the production of clearer imagery due to the scattering properties of various objects. In yet other applications, dual polarization can be utilized to facilitate rejection of cross-polarized interference and to facilitate the rejection of rain clutter. A variety of other applications, utilizing dual polarization antennas, are readily recognized by those skilled in the art.

SUMMARY OF THE INVENTION

According to one embodiment of the invention, an array antenna includes a substrate body, a first antenna element, and a second antenna element. The first antenna element is coupled to the substrate body and is operable to transmit or receive a first signal. The second antenna element is coupled to the substrate body and is operable to transmit or receive a second signal. The first antenna element is of a different type than the second antenna element. The direction of polarization of the first signal is different than the direction of polarization of the second signal.

According to another embodiment of the invention, a method of transmitting or receiving signals with two different polarizations from an array antenna includes providing a first antenna element and providing a second antenna element. The first antenna element is different than the second antenna element. The method also includes transmitting or receiving a first signal having a first polarization from the first antenna element and transmitting or receiving a second signal having a second polarization from the second antenna element. The direction of the second polarization is different than the direction of the first polarization.

Some embodiments of the invention provide numerous technical advantages. A technical advantage of one embodiment of the present invention may include the capability to provide dual polarization array antennas with decreased complexity and/or cost. Other technical advantages of the present invention may include the capability to utilize a common substrate for feed lines that drive antenna elements with different polarizations.

While specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

For a more complete understanding of embodiments of the present invention and their advantages, reference is now made to the following description, taken in conjunction with the accompanying drawings, in which.

DETAILED DESCRIPTION OF EXAMPLE EMBODIMENTS OF THE INVENTION

It should be understood at the outset that although example implementations of embodiments of the invention are illustrated below, the present invention may be implemented using any number of techniques, whether currently known or in existence. The present invention should in no way be limited to the example implementations, drawings, and techniques illustrated below. Additionally, the drawings are not necessarily drawn to scale.

While dual polarized array antennas have numerous advantages, the production of some dual-polarized array antennas can be either labor intensive or cost-prohibitive. For example, some configurations (namely, cross-notch configuration or cross-dipole configurations) create a dual-polarization effect by positioning similar radiating elements at right angles to one another. In these configurations, the radio frequency feed lines (utilized to couple signal sources to the radiating elements) can not remain coplanar. Rather, at least one of the feed lines needs a bend, twist, or some other transition to connect to its respective element. Such bends and/or twists undesirably increase the time and/or expenses involved in creating the dual-polarized array antenna. They also cause reflections and loss that reduce the antenna's efficiency. Accordingly, the teachings of the invention recognize that it would be desirable for a configuration that could create such a dual-polarization array antenna, yet avoid and/or minimize the above concerns. Embodiments below address such concerns.

FIGS. 1A, 1B, 2A, and 2B are generally illustrative of embodiments of array antennas capable of dual polarization. The array antennas generally include interleaved sets of different types of antenna elements, one type of antenna element of which has a first polarization and the other type of antenna element of which has a second polarization. Each set of antenna elements is driven by feed lines on a common substrate. With such configurations, there need be no discontinuities, transitions, or connectors between the antenna elements and their associated radio frequency electronic components.

Figure 1A:
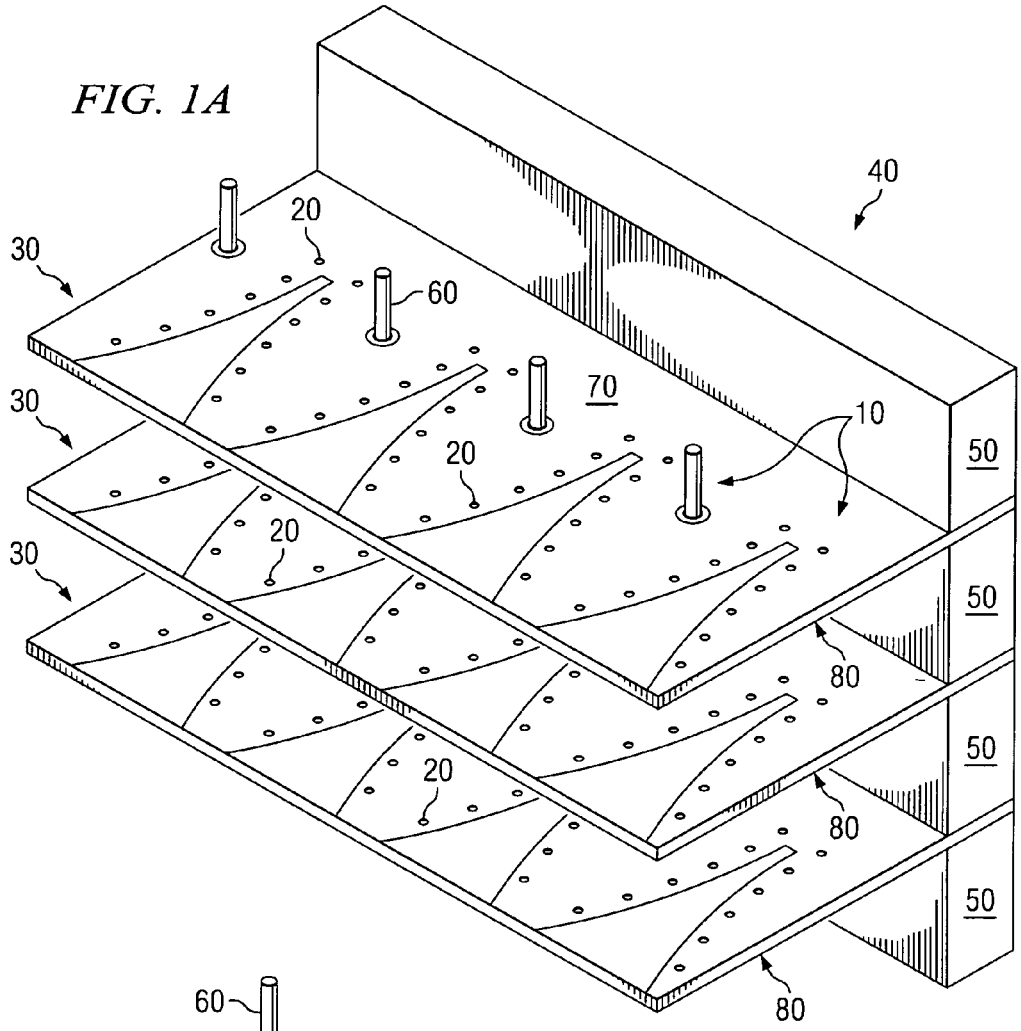
FIG. 1A is a perspective view of a configuration of an array antenna, according to an embodiment of the invention.

FIG. 1A is a perspective view of a configuration of an array antenna 40, according to an embodiment of the invention. The array antenna 40 is shown generally with sets 30 of different types of antenna elements 10 interleaved on substrates 80. There may be any number of substrates 80 and spacers 50, and both may be of any width. The substrates 80 may contain any number of elements 10.

In this embodiment, two types of antenna elements 10 are utilized: monopole radiators 60 and flared notch radiators 70. Each monopole radiator 60 is paired with a flared notch radiator 70. In such a pairing, the monopole radiators 60 are shown centered between the flared notch radiators 70 to form an interleaving of the antenna elements 10. Although such a configuration is shown in this embodiment, it should be understood that other configurations can be utilized in other embodiments of the invention. In such other embodiments, other types of antenna elements 10 can be utilized. For example, antennas elements 10 other than flared notch radiators 70 and monopole radiators 60 can be utilized.

The operation of flared notch radiators 70 and monopole radiators 60 should become apparent to one of ordinary skill in the art. In this embodiment, the monopole radiators 60 are vertically polarized while the flared notch radiators 70 are horizontally polarized. Thus, the direction of the polarization of the monopole radiators 60 is orthogonal to the direction of the polarization of the flared notch radiators 70. With the description of polarization of the antenna elements 10, it will be recognized by one of ordinary skill in the art that such polarized antenna elements 10 (the monopole radiators 60 and the flared notch radiators 70) can be utilized to transmit and/or receive a signal. For example, in some embodiments, both sets of antenna elements 10 can transmit and receive signals. In other embodiments, both sets of antenna elements 10 can transmit signals, while only one antenna element 10 receives signals. In yet other embodiments, both antenna elements 10 can only receive signals or both antenna elements 10 can only transmit signals. Yet further configurations can be utilized in other embodiments as will be recognized by one of ordinary skill in the art. In some embodiments, each pair of orthogonal elements may be driven by a device that controls their relative amplitude and phase in order to produce a radiated field with a specific polarization.

While specific configurations of the monopole radiators 60 and flared notch radiators 70 have been shown, a variety of other configurations can be utilized in other embodiments. For example, the flared notch radiators 70, while shown having an exponentially tapered notch in FIG. 1A, can have other shapes to form the notch. Such shapes include, but are not necessarily limited to, linear tapering (producing a V-shape) and stair-stepped tapering. Additionally, while the monopole radiators 60 are shown as a rod in FIG. 1A, the monopole radiators 60 can have end loads (for example, having a wider head at the top), conical shapes, and/or dielectric sleeves. Other embodiments can utilize yet other configurations that should become apparent to one of ordinary skill in the art.

Figure 1B:
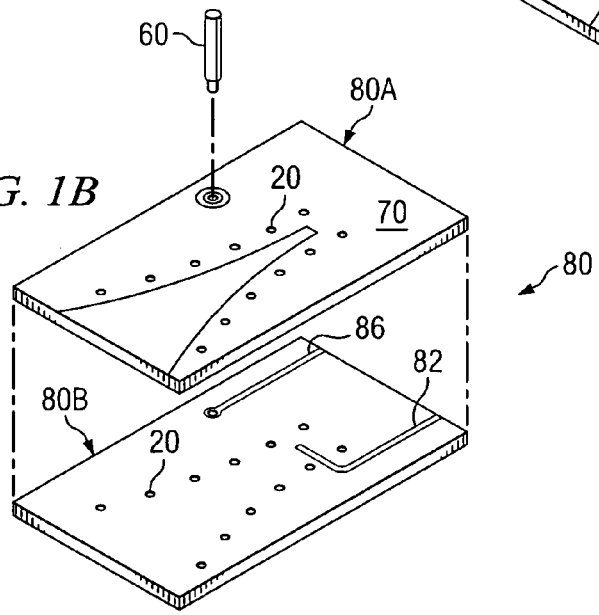
FIG. 1B is an exploded and disassembled view, showing a portion of the array antenna of FIG. 1A.

FIG. 1B shows an exploded and disassembled view of a portion of the array antenna 40 of FIG. 1A. In FIG. 1B, the substrate 80 is split into two layers, an upper layer 80A and a lower layer 80B. The upper layer 80A includes a metallization pattern formed into the upper layer 80A to produce the flared notch radiator 70. Plated through holes 20 are shown on both the upper layer 80A and lower layer 80B. The plated through holes 20 generally outline the edge of the flared notch radiators 70.

The monopole radiator 60, shown removed from the substrate 80, can be affixed to the upper layer 80A to hold the monopole radiator 60 in position and facilitate the electric conductivity, described below. A variety of techniques can be used for such affixing, including, but not limited to soldering, affixing with conductive epoxy, welding, ultrasonic boding, and the like. To facilitate this affixing, the monopole radiators 60 are preferably made of metallic materials such as copper, brass, gold, silver, or the like.

The lower layer 80B of the substrate 80 includes a horizontal polarity feed line 82 and a vertical polarity feed line 86. Each horizontal polarity feed line 82 (only one explicitly shown in FIG. 1B) provides the radio frequency signal for each flared notch radiator 70, while each vertical polarity feed line 86 (only one explicitly shown in FIG. 1B) provides the radio frequency signal for each monopole radiator 60. The horizontal polarity feed lines 82 and the vertical polarity feed line 86 in this embodiment are strip lines.

With reference to FIGS. 1A and 1B, the substrate 80 can be part of a general circuit board utilized to support electronics (not explicitly shown). As an example, the substrate 80 can be part of a TRIMM board supporting the electronics for the array antenna 40. The remaining portions of the array antenna 40 (e.g., the remaining portions of the substrate 80) are within the skill of one ordinary skill in the art, and therefore, for purposes of brevity, are not described. For each set 30 of interleaved antenna elements 10, it can be seen that the flared notch radiators 70 and monopole radiators 60, utilize a common substrate 80 to receive signals from the horizontal polarity feed lines 82 and the vertical polarity feed lines 86.

The spacers 50 in FIG. 1A are generally shown as blocks. In addition to separating the substrate 80, the spacers 50 can help serve as reflection surface for the monopole radiators 60. A variety of different materials that can be utilized for reflection should become apparent to one of ordinary skill in the art. While a general block configuration for spacers 50 has been shown, it should be understood that a variety of other configurations can be utilized, including, but not limited, to configurations with blocks, posts, or the like.

Figure 2A:
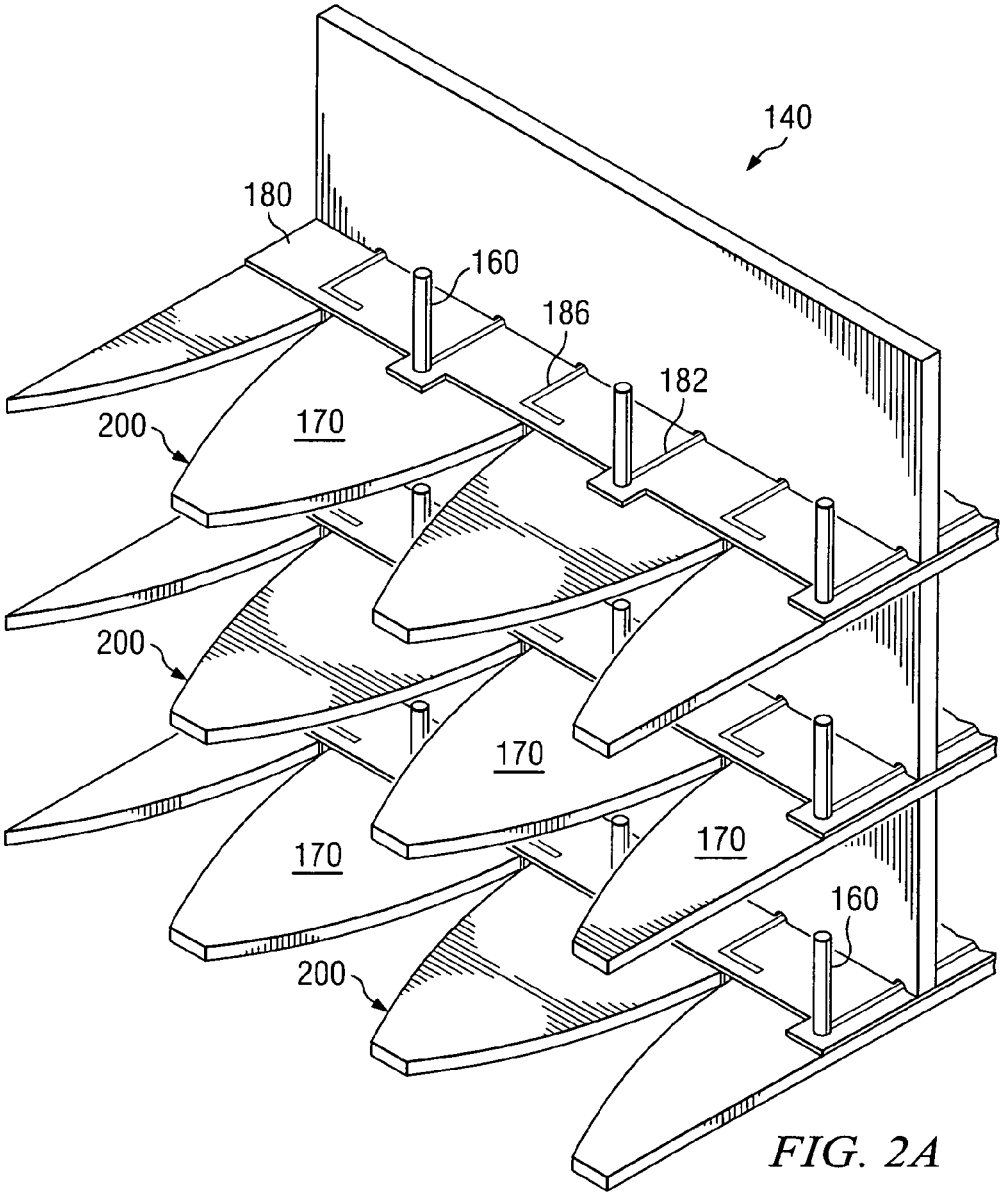
FIG. 2A is a perspective view of another configuration of an array antenna, according to another embodiment of the invention.
Figure 2B:
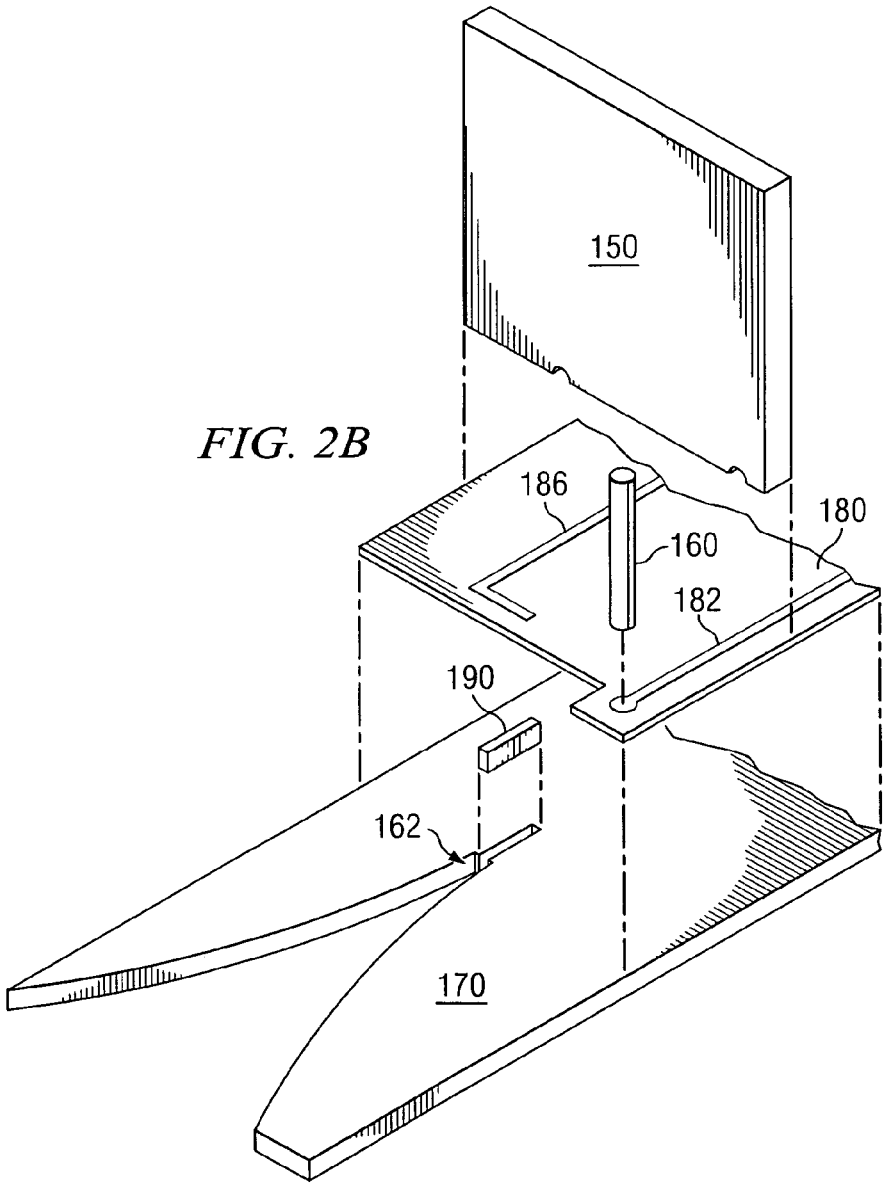
FIG. 2B is an exploded and disassembled view, showing a portion of the array antenna of FIG. 2A.

FIG. 2A is a perspective view of another configuration of an array antenna 140, according to another embodiment of the invention. FIG. 2B is an exploded and disassembled view, showing a portion of the array antenna 140 of FIG. 2A. The array antenna 140 of FIGS. 2A and 2B operates in a similar manner to the array antenna 40 of FIGS. 1A and 1B, except for the following. Array antenna 140 includes any number of shelves of metal plates 200. The metal plates 200 may be of any width and may contain any number of notch radiators 170. Flared notch radiators 170 are formed into the edge of the metal plate 200 by machining, chemical etching, or any other suitable means. Positioned on top of each metal plate 200 is a substrate 180, which can be made of similar materials to the substrate 80 of FIGS. 1A and 1B, or other materials recognized by those of ordinary skill in the art. The monopole radiators 160 couple to the substrate 180. Embedded within the substrate 180 are vertical polarity feed lines 182 and horizontal polarity feed lines 186, which in this embodiment are microstrips. A dielectric filler 190 can be utilized in a base 162 of the flared notch radiator 170 to provide support for the horizontal polarity feed line 182 where it crosses the base 162 of the flared notch radiator 170. The vertical polarity feed line 182 and the horizontal polarity feed line 186 may utilize the metal plate 200 as a ground plane. The plate 150 can be utilized in a manner similar to the spacers 50, facilitating a separation of the metal plates 200 and serving as a reflection surface for the monopole radiators 160.

One of ordinary skill in the art will recognize that embodiments of the invention are capable of providing effective wide angle scanning in an array environment. Some embodiments can additionally produce desirable levels of isolation and orthogonality when measured over varying scan angles. As an example of these measured levels, isolation can generally be the measure of power coupled to the flared notch radiator when the monopole radiator is transmitting or vice versa. Orthogonality can generally be a measure of the difference in polarization states radiated by each of the elements in the interleaved array pair.

Although the present invention has been described with several embodiments, a myriad of changes, variations, alterations, transformations, and modifications may be suggested to one skilled in the art, and it is intended that the present invention encompass such changes, variations, alterations, transformation, and modifications as they fall within the scope of the appended claims.

What is claimed is:

1. An array antenna comprising:

at least one substrate body;

a plurality of first antenna elements that are not monopole radiators, the plurality of first antenna elements coupled to the at least one substrate body and operable to transmit or receive a first signal;

a plurality of second antenna element elements that are monopole radiators, the plurality of second antenna elements coupled to the at least one substrate body and operable to transmit or receive a second signal; wherein the plurality of first antenna elements is of a different type than the plurality of second antenna elements, and the direction of polarization of the first signal is different than the direction of polarization of the second signal.

2. The array antenna of claim 1, wherein the direction of polarization of the first signal is orthogonal to the direction of polarization of the second signal.

3. The array antenna of claim 1, wherein the plurality of first antenna elements is a flared notch radiator and the plurality of second antenna elements is not a flared notch radiator.

4. The array antenna of claim 1, wherein the plurality of first antenna elements is a flared notch radiator.

5. The array antenna of claim 4, wherein:

the at least one substrate body includes a circuit board, the flared notch radiator is embedded in the circuit board, and the monopole radiator is affixed to the circuit board.

6. The array antenna of claim 4, wherein the flared notch is formed into the edge of a metal plate.

7. The array antenna of claim 1, further comprising:

a first feed line and a second feed line, wherein the first and second feed lines are embedded in the at least one substrate body, and the first and second feed lines are operable to provide radio frequency signals to the first and second types of antenna elements.

8. The array antenna of claim 7, wherein the first and second feed lines are strip line feeds.

9. The array antenna of claim 7, wherein the first and second feed lines are microstrip feeds.

10. An array antenna comprising:

a substrate body;

a plurality of first antenna elements that are not monopole radiators, the plurality of first antenna elements coupled to the substrate body and operable to transmit or receive a first signal having a first polarization;

a plurality of second antenna elements that are monopole radiators, the plurality of second antenna elements coupled to the substrate body and operable to transmit or receive a second signal having a second polarization; wherein the plurality of first antenna elements is of a different type than the plurality of second antenna elements, and the direction of the second polarization of the second signal is different than the direction of the first polarization of the first signal.

11. The array antenna of claim 10, wherein the direction of the first polarization of the first signal is orthogonal to the direction of the second polarization of the second signal.

12. The array antenna of claim 10, wherein the plurality of first antenna elements is a flared notch radiator and the plurality of second antenna elements is not a flared notch radiator.

13. The array antenna of claim 10, wherein the plurality of first antenna elements is a flared notch radiator.

14. The array antenna of claim 13, wherein the substrate body includes a circuit board, the flared notch radiator is embedded in the circuit board, and the monopole radiator is affixed to the circuit board.

15. The array antenna of claim 10, further comprising:

a first feed line and a second feed line, wherein the first and second feed lines are embedded in the substrate body, and the first and second feed lines are operable to provide radio frequency signals to the first and second antenna elements.

* * * * *